US006010083A

United States Patent [19]

Roe et al.

[11] Patent Number: 6,010,083

[45] Date of Patent: Jan. 4, 2000

[54] APPARATUS AND METHOD FOR GENERATING HIGH QUALITY FOAM USING AN AIR EDUCTOR

[75] Inventors: Donald C. Roe, Jamison, Pa.; Ragula Bhaskar, Salt Lake City, Utah; Bradley J. Utzka, Philadelphia, Pa.

[73] Assignee: BetzDearborn Inc., Trevose, Pa.

[21] Appl. No.: 09/173,933

[22] Filed: Oct. 16, 1998

[51] Int. Cl.[7] ..... B05B 7/04

[52] U.S. Cl. ..... 239/427.5; 239/428.5; 261/DIG. 26

[58] Field of Search ..... 239/427–427.5, 239/428.5, 432, 8, 9; 261/DIG. 26

[56] References Cited

U.S. PATENT DOCUMENTS

| | | | |
|---|---|---|---|
| 3,388,868 | 6/1968 | Watson et al. | 239/428.5 X |
| 3,430,865 | 3/1969 | McDougall | 239/427.5 |
| 3,811,660 | 5/1974 | Cole, Jr. | 261/DIG. 26 X |
| 3,954,662 | 5/1976 | Salyer et al. | 252/382 |
| 4,207,202 | 6/1980 | Cole, Jr. | 261/DIG. 26 X |
| 4,400,220 | 8/1983 | Cole, Jr. | 239/8 X |
| 4,474,680 | 10/1984 | Kroll | 239/8 X |
| 4,732,181 | 3/1988 | Sollander et al. | 239/428.5 X |
| 5,085,371 | 2/1992 | Paige | 239/428.5 X |
| 5,167,285 | 12/1992 | Williams et al. | 239/423 X |
| 5,312,041 | 5/1994 | Williams et al. | 239/8 |
| 5,613,773 | 3/1997 | Scott et al. | 366/163.2 |
| 5,645,649 | 7/1997 | Cole, Jr. | 134/18 |

*Primary Examiner*—Lesley D. Morris
*Attorney, Agent, or Firm*—Steven D. Boyd

[57] ABSTRACT

A foam generating apparatus and system for generating high quality foam suitable for dust control is disclosed. The apparatus is an eductor that makes use of the energy of a high pressure stream of aqueous foaming solution to draw air into the foaming solution and force it through a foam generator. A dust control foam system is described which employs such air eductors. The described foaming system requires only a single pressurized line to supply foaming solution obviating the need for a compressed air line.

7 Claims, 1 Drawing Sheet

APPARATUS AND METHOD FOR GENERATING HIGH QUALITY FOAM USING AN AIR EDUCTOR

FIELD OF THE INVENTION

The present invention relates to the field of foam dust control generating apparatus and methods. More particularly, the present invention relates to a foam generating apparatus and method which incorporates an air eductor to generate a high quality foam for dust control applications.

BACKGROUND OF THE INVENTION

Dust dissemination poses safety, health and environmental problems in many commercial environments. For example, in many industries such as mining, mineral processing, agricultural, power, steel and paper, the transportation handling and storage of bulk solids is common. One major problem associated with the handling of bulk solids is dust generation and the subsequent emission of a dust into the atmosphere.

Industrial sources of fugitive dust include production, open operations, leaks and spills, storage, disposal, transit or poor house keeping of sundry finely divided solid particulates. Mining industries are replete with examples of the above-enumerated categories. For example, coal mining operations encounter dust dissemination during production, transportation, storage and use.

A typical method for controlling or suppressing dust is to apply a water spray. However, water sprays only control dust for a short period of time depending upon environmental conditions. The application of the spray has to be repeated frequently to provide ongoing dust control. Water sprays for dust control on coal can affect the BTU content of the coal due to wetting, as well as cause significant handling problems when temperatures are below freezing.

Various foam treatments have been utilized to control dust emissions. U.S. Pat. No. 3,954,662 discloses aqueous foamable compositions and their use to control coal dust which comprises water, a detergent wetting agent and an interpolymer of a polymarizable vinyl ester and a partial ester component. U.S. Pat. No. 4,400,220 discloses a method and apparatus for supplying foam to a dusty material to prevent dust particles from becoming airborne. The method includes forming a dust suppressing foam by forcing a mixture of air, water and a surfactant through a foam generating apparatus. The foam generating apparatus forms foam of small bubble size by pushing the unfoamed mixture through a myriad of tortuous passages. The foam generating apparatus requires separate sources of foaming agent, water and compressed air, which are mixed just prior to being forced through the foam generating apparatus. The apparatus provides a foam of sufficient quality and bubble size to suppress respirable dust. However, the apparatus requires three separate feed lines to the mixer/foamer, which complicates the system. One feed line is compressed air, which would require an air compressor.

Foam generating apparatus, which employ an air eductor to obviate the need for an air compressor, are used in fire fighting foam generation. U.S. Pat. No. 5,613,773 discloses an apparatus and method for generating foam from a pressurized liquid. The pressurized liquid is water. Passage of the water through an eductor draws in a foam concentrate which is mixed with the water and thereafter generated into foam by passage through an agitator orifice. The air component of the foam is drawn into the foam concentrate/water mixture as it passes through the agitator orifice. The apparatus of U.S. Pat. No. 5,613,773 does not require an air compressor or a separate pressurized air line. However, a separate line is required for the water and the foaming concentrate. Furthermore, the foam generated by the apparatus disclosed in U.S. Pat. No. 5,613,773, suitable fire fighting, is of relatively low quality. That is, foam suitable for fire fighting is relatively "wet" in that it contains a relatively high percentage of water, increasing the amounts of water in the foam decreases the foam expansion ratio. Also, foam suitable for fire fighting has relatively large bubbles and a limited half life due in part to the high percentage of water. The large bubble size and high water content of fire fighting foam makes it unsuitable for dust control use.

SUMMARY OF THE INVENTION

The present invention reduces the complexities of foam generating apparatus, which produces a high quality foam suitable for dust suppression. The apparatus and method of the present invention provides a dust suppressing foam, having an expansion ratio greater than about 10 and a foam half life of greater than about three minutes. The dust suppressing foam is generated in an apparatus that employs a single pressurized foaming solution feed line to supply a high pressure aqueous foaming solution to a foam generator. The foam generator employs an air eductor means to entrain air into the aqueous foaming solution, which is agitated to generate foam. The high pressure aqueous foaming solution provides the pressure energy needed to force the liquid and entrained air through the foam generator where high quality foam is produced.

DESCRIPTION OF THE PREFERRED EMBODIMENT

The term foam as used herein designates a mixture of liquid, gas and a surfactant that gives the liquid a film strength which permits the formation of long lasting bubbles when the mixture is agitated to convert it into a mass of bubbles. The liquid used is typically water and the gas air, but other gases and/or liquids can be used when compatible with a surfactant. Various compounds are used as surfactants, and are commercially available. The strength of the film is dependent upon the characteristics of the surfactant and the amount of surfactant in the liquid-gas mixture.

The preferred mixture for the present invention is a mixture of air, water and a surfactant that will provide a high film strength. When such a mixture is employed in conventional fire fighting foam generating equipment, a high expansion ratio foam is produced which has relatively large, water wet bubbles.

While the present invention uses a commercial surfactant, the expansion ratio of the foam is significantly reduced by the fact that small bubbles are formed. In addition, the apparatus of the present invention makes use of an air eductor to entrain air into a foaming solution of water and surfactant. Thus, the apparatus of the present invention requires a single liquid feed line and does not require a separate source of compressed air.

Figure 1:
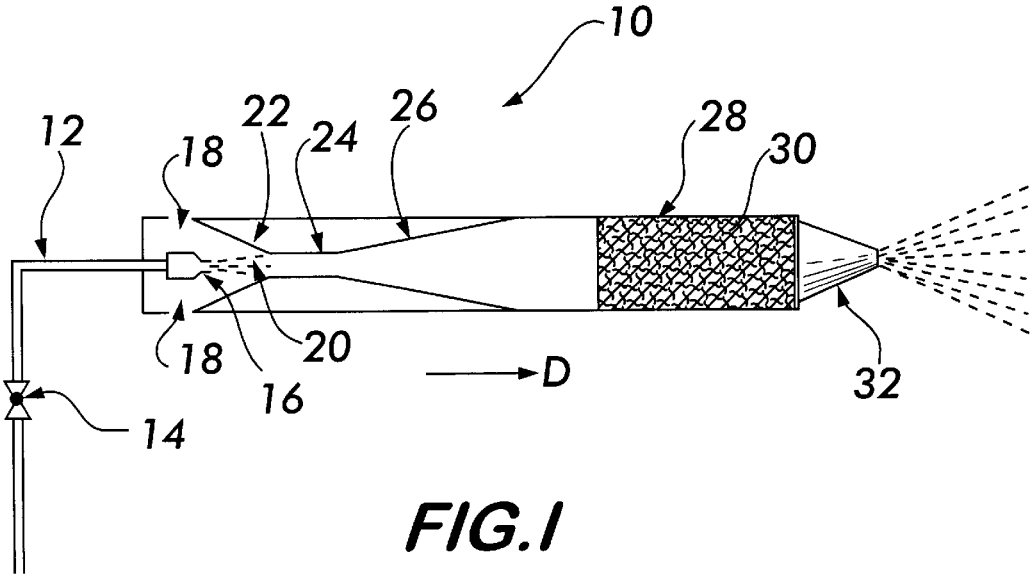
FIG. 1 is a simplified fragmented longitudinal cross section of the foam generating apparatus according to the present invention.

FIG. 1 is a diagrammatic sectional view of apparatus in accordance with the present invention. A mixture of foaming solution comprising water and surfactant (foaming agent) is supplied to apparatus 10 through line 12. The mixture is supplied at high pressure, from about 500 to about 1500 pounds per square inch. The mixture can be pressurized by any conventional means. For example, in a coal mining situation, the hydraulic circuit of the mining equipment can be employed to drive a hydraulic motor connected to a water booster pump which increases the typical mine water pressure of 60 to 100 pounds per square inch to the required 500 to 1500 pounds per square inch. The line 12 may include a control valve 14 which may be independently operable or, optionally, automatically controlled by operation of the mining equipment for which the dust control foam is desired.

The high pressure foaming solution is forced through a liquid spray nozzle 16. The liquid spray nozzle 16 is oriented adjacent air inlet ports 18. The liquid spray nozzle 16 directs a spray of high pressure liquid into an eductor inlet 20 formed by walls 22 which converge in a downstream direction (arrow D). As the high pressure foaming solution flows through the converging eductor inlet, the change in pressure draws air in through air inlet ports 18 into the foaming solution. The foaming solution with air entrained therein flows through constant diameter section 24 and into a diverging section 26 of the eductor where the velocity of the flowing foaming solution decreases and the pressure increases. Extending from diverging section 26 is a relatively constant cross sectional foam generating manifold 28. Foam generating manifold 28 is filled with a packing material 30 which comprises a myriad of small interconnecting passageways such as a fine mesh packing material. The foaming solution and entrained air are forced through the packing material where a high degree of mixing occurs. The mixing action causes the formation of high quality (small bubble) foam. A diverging foam outlet nozzle 32 extends from the foam generating manifold 28 which directs the high quality foam at the material to be treated.

In the apparatus of the present invention, the design parameters of the eductor must be optimized in order to provide the high quality foam required for dust control. These design parameters include the orientation of the high pressure liquid spray nozzle 16 and its spatial relationship to the constant diameter section 24 or throat of the eductor. The spray nozzle 16 must be oriented at an appropriate distance from the constant diameter section 24 to draw in sufficient air to provide foam of the required quality. The diameter of the constant diameter section 24 must be sized, in relation to the volume of liquid being sprayed, so that sufficient back-pressure develops in the foam generating manifold 28 to produce the required high quality foam. As the flow rate of the foaming solution or the pressure of the foaming solution changes, modifications of these design parameters may be necessary to produce foam of the required quality.

For example, the inventors of the present invention have developed an eductor which operates at a one gallon per minutes flow of foaming solution of 1,000 psi which produces a foam having an expansion ratio greater than 10 and a half life greater than three minutes. The eductor employs a full cone, 15 degree spray nozzle oriented 0.550 inches from the eductor throat. The eductor throat has a diameter of 0.250 inches. The packing material, 6.25 grams of a commercial scouring pad, was oriented about eight inches from the eductor discharge. This eight inch spacing provided for a back pressure of about 10–12 pounds per square inch. The resulting foam generator produced about 2.75 cubic feet per minute foam of the required quality with an average air flow of about 2.9 cubic feet per minute.

The high quality foam formed by the apparatus of the present invention has bubbles of sufficiently small size and a foam half life suitable for controlling dust dissemination. The foam, when applied to the surface of a dust prone material, inhibits dust dissemination. The material being treated, including dust particles, bursts the bubbles which they contact, the bursting of the bubbles traps and coats the surface of the material with the liquid of which the bubble was formed.

This traps the wetted particle on the surface of adjacent material. With broken dusty material, the dust is suppressed by projecting the small bubble foam into the broken material while the material is in motion. The rate of foam supplied is coordinated with the quantity of particles to maintain a supply of foam during the entire operation for preventing additional particles of dust from becoming airborne.

Where the transfer of dusty material from one support to another as by free fall to the other support, the small bubble foam is projected into the material to trap the dust thereof while larger particles of the material are separated from one another as a result of free fall.

For example, the apparatus of the present invention is particularly well suited to control dust during underground mining operations, such as coal mining. In coal mining operations, the use of large amounts of water for dust control increase transportation costs, reduces the BTU/ton of shipped coal and can create handling problems during freezing weather conditions. The use of a high quality foam which has a low water content controls the dust dissemination while minimizing such problems. The apparatus of the present invention is compact, rugged (it has no moving parts) and requires only a single feed line of foaming solution. The apparatus is compact so that it can be conveniently mounted on or near dust generating locations. Since the foam is produced very near the dust source, the foam does not have to be transported long distances through hoses, and hence does not break down significantly prior to use.

Figure 2:
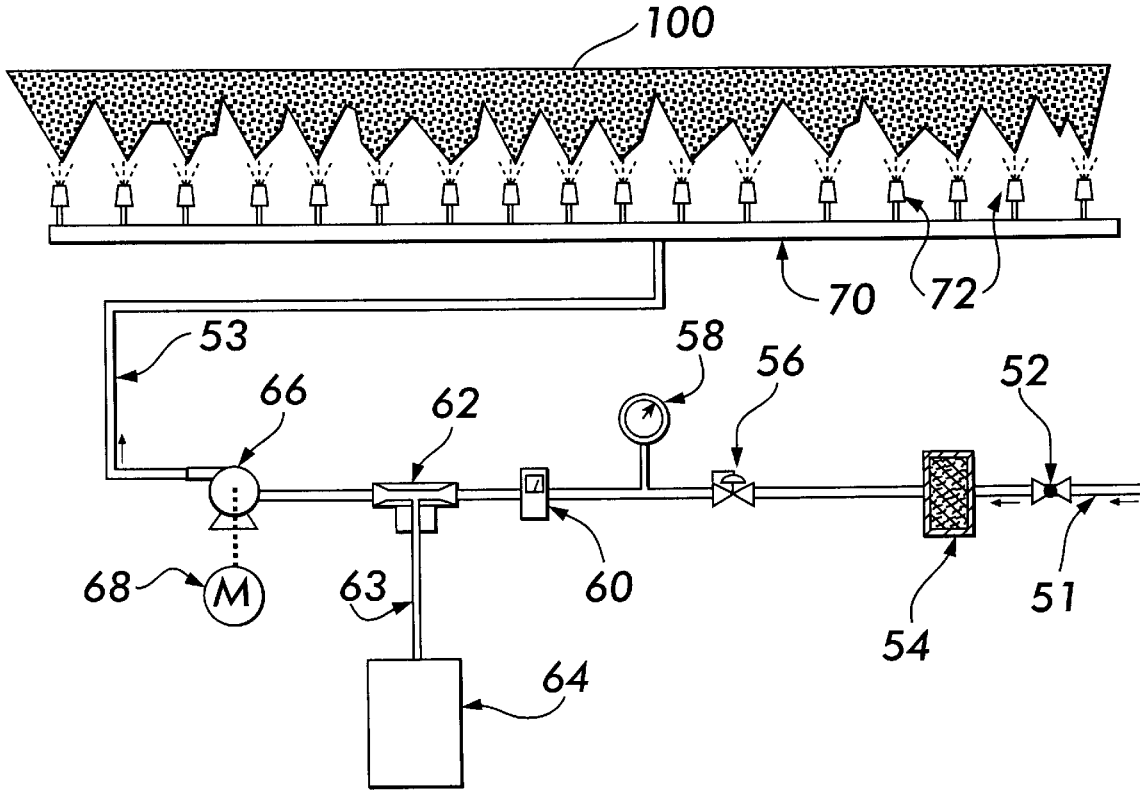
FIG. 2 is a simplified schematic of a foam generating system, which employs the foam generating apparatus according to the present invention.

FIG. 2 is a schematic of a foam generating system for use in underground mining operations, which incorporates the foam generating apparatus of the present invention. A water source controlled by inlet valve 52 provides water through line 51. Typical pressures for the water source range from 50 to 200 pounds per square inch. A filter or strainer 54 may be used to remove gross impurities. Preferably a pressure regulator 56 and pressure gauge 58 are used in conjunction with a flow meter 60 to monitor the amount of water used in the system. The water flowing in line 51 flows through a chemical eductor 62 which draws a suitable foaming agent from tank 64 through line 63, thereby forming a foaming solution. The foaming solution is pressurized to about 500 to 1200 pounds per square inch by booster pump 66. The booster pump is preferably powered by a hydraulic drive motor 68 powered by the hydraulic oil of the mining machine and/or other hydraulic source near the foam generating assemblies 72. The high pressure foaming solution flows through line 53 to a distribution header 70. Attached to distribution header 70 are a plurality of foam generating assemblies 72 as described above.

The system shown in FIG. 2 provides a dust suppressing high quality foam to a foam feed point 100 such as a mine face which requires a single low pressure feed of water through line 51. The foam generating equipment shown in FIG. 2 from pressure regular 56 through the foam generating assemblies 72 can be conveniently mounted on the mining equipment and use the mining equipment hydraulic system for power. The system of the present invention obviates the need for an air compressor and related air and electrical lines, and other than the booster pump 66, which can be a piston or diaphragm pump, there are no moving parts to monitor and maintain. Operation of the system can be manual to be activated when foam dust control is needed, or can be automatically activated by operation of the mining equipment.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A foam generating apparatus for generating high quality foam from a flow of pressurized aqueous foaming solution comprising:

(a) an inlet to receive pressurized, aqueous foaming solution;

(b) an liquid spray nozzle to discharge said pressurized aqueous foaming solution comprising an eductor nozzle oriented adjacent one or more eductor air inlet means, said eductor nozzle oriented upstream of an eductor inlet which converges in a downstream direction to an eductor throat which thereafter diverges in a downstream direction toward an eductor outlet whereby a flow of pressurized aqueous foaming solution through said eductor nozzle into said eductor inlet in a downstream direction draws air in through said air inlet means into said pressurized foaming solution flowing through said eductor;

(c) a relatively constant cross section foam generating manifold extending from said eductor outlet to a diverging foam outlet nozzle;

(d) agitator means in said foam generating manifold to agitate the flowing foaming solution and air entrained therein into a high quality foam having an expansion ratio greater than about 10 and a foam half life greater than about three minutes.

2. The apparatus of claim 1 wherein said agitator means comprises a fine mesh packing material.

3. A method of generating high quality foam from a flow of pressurized aqueous foaming solution comprising:

(a) passing the flow through a liquid spray nozzle comprising an eductor nozzle oriented adjacent one or more eductor air inlet ports, said eductor nozzle oriented upstream of an eductor inlet which converges in a downstream direction to an eductor throat which thereafter diverges in a downstream direction toward an eductor outlet whereby a flow of pressurized aqueous foaming solution through said eductor nozzle into said eductor inlet in a downstream direction draws air in through said air inlet ports into said pressurized foaming solution;

(b) passing said pressurized foaming solution including air through an agitator means to agitate the flowing foaming solution and air into a high quality foam having an expansion ratio greater than about 10 and a foam half life greater than about three minutes.

4. A foam generating system for generating a high quality foam solution for dust control comprising:

(a) a source of pressurized water;

(b) a source of foaming agent;

(c) means for conveying water from said water source to a chemical eductor;

(d) means to convey said foaming agent to said chemical eductor whereby flow of said water through said chemical eductor draws foaming agent into said water forming a foaming solution;

(e) pump means for increasing the pressure of said foaming solution forming high pressure foaming solution;

(f) distribution means to distribute said high pressure foaming solution to a foam generator means comprising air educators whereby flow of said high pressure foaming solution through said foam generator means draws air into said high pressure foaming solution which is thereafter forced through a foam generator manifold whereby the flowing foaming solution and air is agitated to form a high quality foam having an expansion ratio greater than about 10 and a foam half life greater than about three minutes;

(g) discharge means to direct said high quality foam onto a dust producing substrate.

5. The foam generating apparatus of claim 4 wherein said means for conveying water includes flow regulating and measuring means.

6. The foam generating apparatus of claim 4 wherein said means for conveying water includes pressure regulating and measuring means.

7. The foam generating apparatus of claim 4 whereby said pump means comprises a booster pump powered by a hydraulic drive motor.

* * * * *